United States Patent [19]

Lowry

[11] Patent Number: 4,640,418

[45] Date of Patent: Feb. 3, 1987

[54] PROTECTIVE BULK PACK CONTAINER FOR ICE CREAM CONES

[75] Inventor: Bobby Lowry, Norcross, Ga.

[73] Assignee: June A. Lowry, Decatur, Ga.

[21] Appl. No.: 720,997

[22] Filed: Apr. 8, 1985

[51] Int. Cl.[4] ..... B65D 81/16; B65D 85/36

[52] U.S. Cl. ..... 206/499; 206/523; 206/588; 217/27; 426/124

[58] Field of Search ..... 206/443, 446, 499, 514, 206/523, 526, 562, 586, 587, 591, 592–594, 589; 217/25.5, 27; 426/108, 110, 119, 128, 124, 411, 413

[56] References Cited

U.S. PATENT DOCUMENTS

| | | | |
|---|---|---|---|
| 1,008,963 | 11/1911 | Ekermeyer | 206/588 |
| 1,305,908 | 6/1919 | Lanier | 206/499 |
| 1,926,916 | 9/1933 | Reeves | 217/25.5 |
| 3,120,319 | 2/1964 | Buddrus | 206/523 |
| 3,146,112 | 8/1964 | Weinstein | 206/499 |
| 3,240,331 | 3/1966 | Weinstein | 206/499 |
| 3,241,661 | 3/1966 | Zamzow | 206/523 |
| 3,343,671 | 9/1967 | Weinstein | 426/411 |
| 3,347,354 | 10/1967 | West | 206/523 |
| 3,619,216 | 11/1971 | Weinstein . | |
| 3,745,025 | 7/1973 | Hollinger . | |
| 3,937,332 | 2/1976 | Cohen | 206/499 |
| 4,106,597 | 8/1978 | Shook et al. | 206/523 |
| 4,349,109 | 9/1982 | Scordato et al. | 206/499 |
| 4,349,571 | 9/1982 | Davis | 206/588 |
| 4,522,303 | 6/1985 | Starr | 206/523 |

FOREIGN PATENT DOCUMENTS

| | | | |
|---|---|---|---|
| 1008423 | 5/1952 | France | 217/25.5 |
| 1210324 | 3/1960 | France | 206/523 |
| 1002236 | 8/1965 | United Kingdom | 206/523 |

*Primary Examiner*—William Price
*Assistant Examiner*—Jimmy G. Foster
*Attorney, Agent, or Firm*—Jones & Askew

[57] ABSTRACT

A protective bulk pack container for ice cream cones comprising at least one protective body formed of a resilient yet rigid material, the protective body including a plurality of cone-receiving passageways for receipt of nested stacks of ice cream cones. The container further includes cover members disposed to close off the cone-receiving passageways and envelope the stacks of ice cream cones contained therein. The protective body and cover members are placed in a paperboard container for shipping.

2 Claims, 4 Drawing Figures

PROTECTIVE BULK PACK CONTAINER FOR ICE CREAM CONES

TECHNICAL FIELD

The present invention relates to bulk pack containers, and more particularly relates to a protective bulk pack container for storing, shipping and dispensing ice cream cones.

BACKGROUND

Because ice cream cones are such fragile articles, they are preferably packed and shipped in such a manner as to protect each and every cone. Yet in an effort to conserve packing space and reduce shipping costs, ice cream cones are conventionally packed in nested stacks and shipped in a container full of many such nested stacks of cones. While this arrangement has achieved the desired conservation of space, it has also resulted in substantial product loss due to breakage. Thus, in the ice cream cone packaging art, there exists a tension between protecting each individual cone and efficiently utilizing packing space.

Various containers are known in the prior art for packing ice cream cones, each of which purports to solve the breakage problem in the context of efficient space utilization. For example, U.S. Pat. No. 3,146,112 to Weinstein discloses an ice cream cone package wherein a plurality of nested and stacked cones are placed in elongated horizontal and vertical channels defined within a container. The channels are formed by folded sheets of corrugated paperboard. The claimed advantage of the arrangement is to resist forces which ordinarily tend to wedge the nested cones together and thereby prevent any damage that could result therefrom.

As a further example, U.S. Pat. No. 3,745,025 to Hollinger discloses a combined shipping, display and dispensing package for ice cream cones. This package includes a protective cone tip pad, a cone tip holder tray and a matrix of pockets, each of which is formed of corrugated paperboard. The effect of this arrangement, and in particular of the cone tip holder tray, is to prevent any contact of the cone tips in a particular stack from contacting the exterior wall of the container. Removal of the cone tip pad and the cone tip holder tray permits dispensing of the cones directly from the matrix of pockets provided within the container.

As a yet further example, U.S. Pat. No. 4,349,571 to Davis et al. discloses a bulk container for transporting and dispensing ice cream cones. This container provides a plurality of folded foam sandwich structures, each of which defines a row of cells. Each cell, in turn, is formed to receive a single ice cream cone. A plurality of folded foam sandwich structures, each with a layer of one ice cream cone stacks, are inserted into an outer container to form a matrix of cells therein. The effect of this arrangement is to create a force fit between the cones and the sandwich structures such that the cells close down on and immobilize the individual cone stack.

Several problems exist with these and the many other prior art containers that purport to relieve the above-described tension in the ice cream cone packaging art. First, no prior art container has proved effective in reducing the amount of cone breakage while conserving packing space by utilizing a nested stack arrangement. Stated differently, no container in the prior art has actually proven cost efficient in terms of both cone breakage reduction and space conservation.

A second problem with such prior art containers is their reliance on paperboard or corrugated paperboard to form and maintain the structure of the container. For example, the effect of any jostling of the Weinstein package described above (U.S. Pat. No. 3,146,112) is to force the outermost portions of the cone against the corrugated edges of the board. Such an action simply erodes such outer portions of the cone or even ruptures the cone structure.

Yet another problem is that even though ice cream cones are perishable, they are often stored temporarily in unrefrigerated warehouses, storerooms and the like that typically provide a hot and humid environment. Because all paper absorbs moisture, prior art containers that rely on paperboard or corrugated paperboard absorb such atmospheric moisture and lose their rigidity. As a result, they may deform or even collapse, thereby causing damage to the cones stored therein. Should the containers be stacked one upon the other, the collapse of one container may cause damage to another container (and the ice cream cones stored therein) if the stack falls.

As opposed to relying on the paperboard to form and maintain the container's structure, the Davis package described above (U.S. Pat. No. 4,349,571) relies on the cone structure itself to maintain a cellular matrix. Such an arrangement is, therefore, only as sturdy and rigid as the cones themselves. Any impacting force sufficient to damage a cone will cause damage to both the package and the cones stored therein. Of course, because of the forced fit arrangement of the package, damage to any one cone will weaken the structure and may result in a collapse of the cone matrix structure. The greatest disadvantage of an arrangement such as that shown by the patent to Davis is the single cone stacks. Such an arrangement fails to provide the desired space conservation.

Yet another problem with such prior art ice cream cone containers is that they fail to effectively isolate the stacks of nested cones one from the other within the container. An arrangement as provided by Hollinger (U.S. Pat. No. 3,745,025) places the cone stacks in such close proximity without sufficient intervening structures that an impacting force causing damage to one stack would cause damage to an adjoining stack.

Thus, the prior art has failed to provide an efficient ice cream cone package in terms of both space conservation and breakage loss. Furthermore, the prior art has heretofore failed to provide a container that sufficiently absorbs an impacting force so as to protect the cones contained therein, but also isolates a stack of nested cones such that any damage is confined to a minimum number of cones in a single stack.

SUMMARY OF THE INVENTION

The present invention solves the above-described problems in the prior art by providing a protective bulk pack container for ice cream cones that conserves packing space and significantly reduces cone loss.

A protective bulk pack container according to the present invention provides a resilient casing body which receives and envelopes a plurality of stacks of nested cones. The stacks are distributed about the casing body so that any impact to the container is either absorbed by the protective body or confined to a single stack, and therefore, to a minimum number of cones. The casing is formed of a foam material having sufficient rigidity to maintain its own structure, and thus, the container is not dependent upon paperboard or corrugated board. A plurality of tubular openings are provided, each of which receives a stack of nested ice cream cones. The diameter of each tubular opening is such that the cones are easily received thereby, but also such that each cone is suspended so as to prevent against any significant movement thereof. A protective bulk pack container according to the present invention has proven effective in reducing the amount of cone breakage during shipping and handling while concerving space within the container by means of a nested stacks of ice cream cones.

Generally described, a protective bulk pack container according to the present invention provides a casing of rigid yet resilient material that defines a plurality of cylindrical passageways which extend therethrough. Each passageway is of a diameter sufficient to receive freely a stack of nested ice cream cones. A pair of cover members are disposed on the end portions of the casing so as to close off the passageways and fully envelope the stacks of nested cones. The casing and cover members are then inserted into a container for shipping.

In a first preferred embodiment of the present invention, a single resilient casing body is provided. In a second preferred embodiment of the present invention, two resilient casing members are provided that cooperate to envelope the stacks of nested cones. The principal advantage of this second embodiment is that removal of the second casing body facilitates dispensing of the cones while they are protected by the first casing body.

Thus, it is an object of the present invention to provide an improved protective bulk pack container for ice cream cones.

It is a further object of the present invention to provide a protective bulk pack container for ice cream cones that conserves space and effectively reduces cone breakage during shipping and handling.

It is a further object of the present invention to provide an improved protective bulk pack container for ice cream cones from which the cones may be dispensed.

It is a further object of the present invention to provide a protective bulk pack container that relies neither on paperboard nor the cone structure to provide package rigidity.

It is a further object of the present invention to provide a bulk pack container for ice cream cones that effectively isolates stacks of nested cones one from the other so as to contain any damage caused to a minimum number of ice cream cones.

It is yet further object of the present invention to provide an insert member of resilient material that encases a plurality of stacks of nested ice cream cones that encases the stacks so as to protect them from any impacting force.

Other objects, features and advantages of the present invention will become apparent from reading the following specification when taken in conjunction with the accompanying drawings.

DETAILED DESCRIPTION

Figure 1:
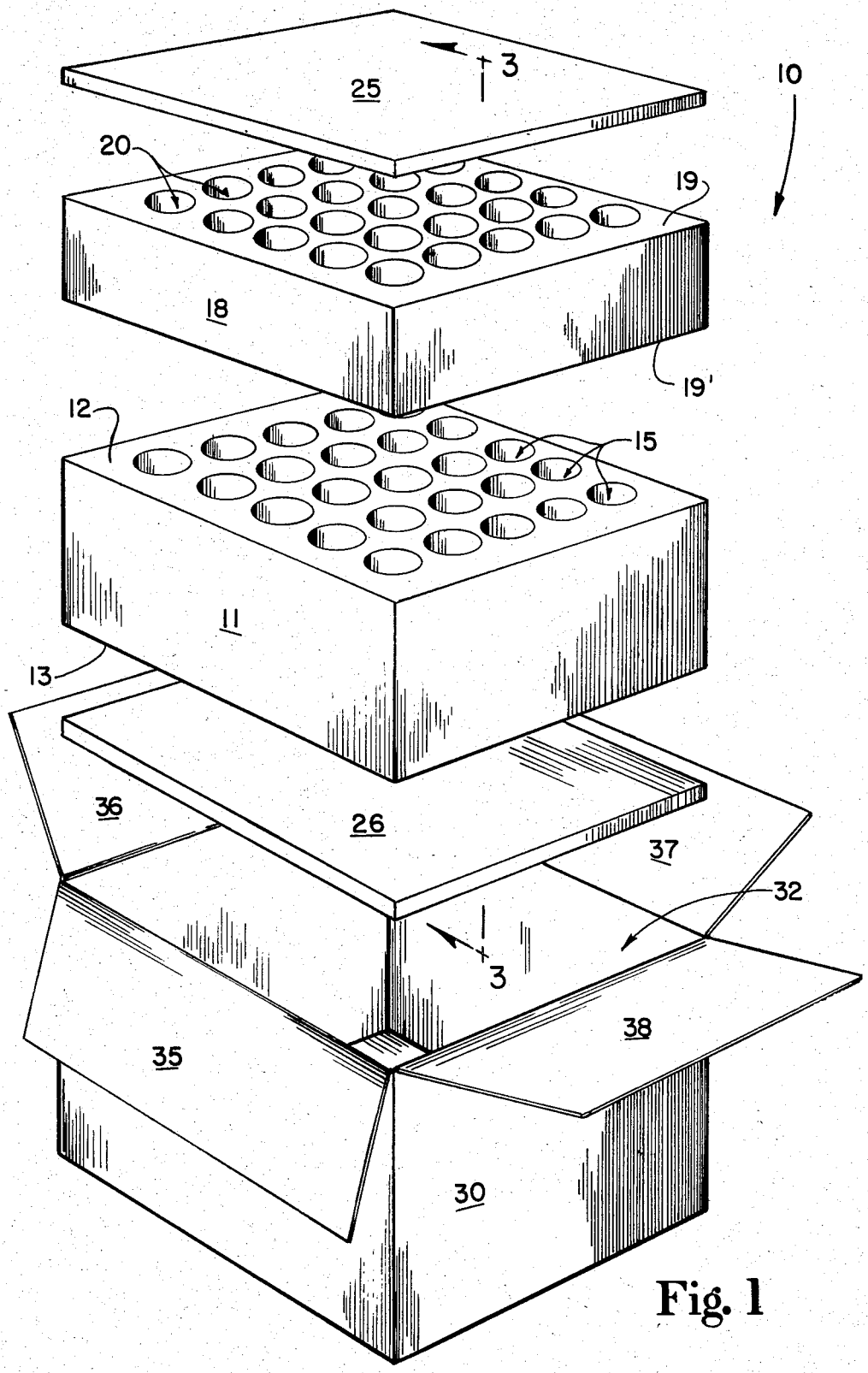
FIG. 1 is an exploded pictorial view of a protective bulk pack container according to a preferred embodiment of the present invention, showing the container as storing a plurality of nested and stacked cones.

Referring now in more detail to the drawings, in which like numerals indicate like parts throughout the several view, FIG. 1 shows a first preferred embodiment of the present invention generally at 10. This embodiment provides a primary protective cone-receiving body 11 and a secondary protective cone-receiving body 18. The primary body 11 is generally rectangular in shape, having a top surface 12 and a bottom surface 13. The primary body 11 is made of a lightweight, impact absorbent material. A preferred material is a resilient plastic foam that not only absorbs any impacting external force, but also regains its original shape upon compression or deformation. While many plastic foams are suitable for such use, a preferred is a semi-rigid polymethane foam. Furthermore, the manner of molding such foam materials is well-known to those in the art and thus it is unnecessary to further disclose the details of either such material or the procedures of forming such a protective body.

Figure 3:
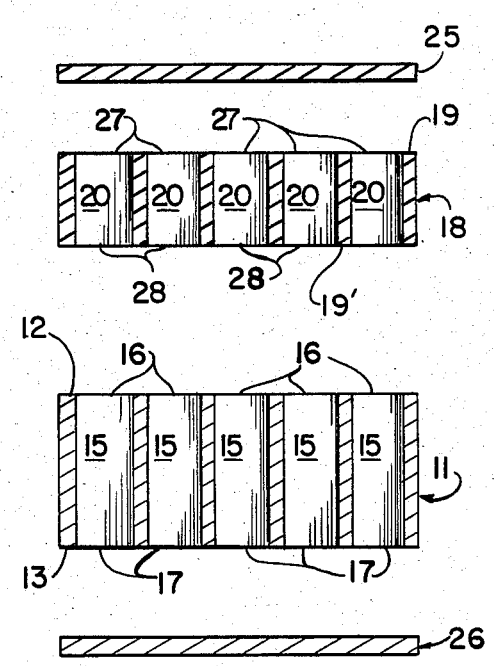
FIG. 3 is an exploded view taken along line 3—3 in FIG. 1.

The primary body 11 defines a plurality of cylindrical cone-receiving passageways 15 (FIG. 3). The passageways 15 extend the entire height of the primary body 11, defining openings 16 and 17 in the top surface 12 and the bottom surface 13, respectively. Each cone-receiving passageway 15 is of a diameter sufficient to receive a selected size of an ice cream cone 16'. Of coarse, the diameter of each passageway may be varied to receive a cone of differing size. Even so, the fit of any selected cone within the cone-receiving passageway 15 is such as to permit easy insertion and withdrawal thereof, but yet restrain the cone from any significant vertical or lateral movement within the passageway. Furthermore, the fit of any selected cone within a cone-receiving passageway 15 is such as to insure against damage to the cone as a result of any such insertion or withdrawal.

The height of each passageway 15 is determined by the height of the primary cone-receiving body 11. Each passageway 15 is of a sufficient length to receive a stack comprised of a selected number of nested ice cream cones. Of course, the height of the primary body may be varied as desired to facilitate receipt of any desired number of cones. A preferred number of cones has been determined to be eight. In association with an eight-cone stack, the preferred height of the primary protective body 11 has been determined to be five inches.

The embodiment of the present invention shown in FIG. 1 further provides a secondary cone receiving body 18. The secondary body 18 is also of a generally rectangular shape, and defines a top surface 19 and a bottom surface 19'. The secondary body 18 is also made of a lightweight, impact absorbent material such as a resilient plastic foam, and provides a plurality of cylindrical cone-receiving passageways 20 which extend from its top surface 19 to its bottom surface 19'. Thus, the height of the cylindrical passageways 20 is determined by that of the secondary body. In association with an eight-cone stack as described above, the preferred height of the secondary protective body 18.

The cylindrical passageways 20 are identical in diameter to that of the cylindrical passageways 15 defined in the primary body 11. The secondary cone-receiving body 18 is configured to be disposed immediately above and pressed flush against the top surface 12 of the primary body 11. Furthermore, the passageways 20 are positioned within the secondary body 18 so as to communicate completely with the passageways 15 defined in the primary body 11. Thus, the effect of mounting the secondary body 18 upon the primary body 11 is to create a plurality of extended or aligned cylindrical passageways 15 and 20 that traverse the combined length of the primary body 11 and the secondary body 18.

A top cover member 25 and a bottom cover member 26 are provided. Each cover member 25 and 26 is shaped and dimensioned to be pressed flush against and conform to either the top surface 12 or the bottom surface 13 of the primary body 11, or the top surface 19 of the secondary body 18. Each cover member 25 and 26 is made of a resilient plastic foam as described in detail hereinabove. If desired, the primary body 11 and the cover members 25 and 26 may be formed so that the cover members are snugly received by the top surface 19 of the secondary body and the bottom surface 13 of the primary body 11. For example, a tongue and groove fit (not shown) or clamp means (not shown) may be provided.

The first preferred form of the present invention further includes a conventional paperboard container 30. The container 30 defines an opening 32, which is dimensioned for snug receipt of the cover members 25 and 26, the primary cone-receiving body 11 and the secondary cone-receiving body 18. Once the cover members 25 and 26, the primary body 11 and the secondary body 18 are placed within the container 30, a series of flaps 35, 36, 37 and 38 are secured in the conventional manner to form the protective bulk pack container 10 of the present invention. As such, the illustrated package 10 provides twenty-five (25) aligned passageways 15 and 20 in the primary body 11 and the secondary body 18, respectively. The primary body is five inches in height and the secondary body is three inches in height. The primary body 11 and the secondary body 18 are each twelve inches in depth and twelve inches in length. The diameter of each passageway is approximately two inches which, as described above, is sufficient for free receipt and withdrawal of a standard size ice cream cone.

Figure 2:
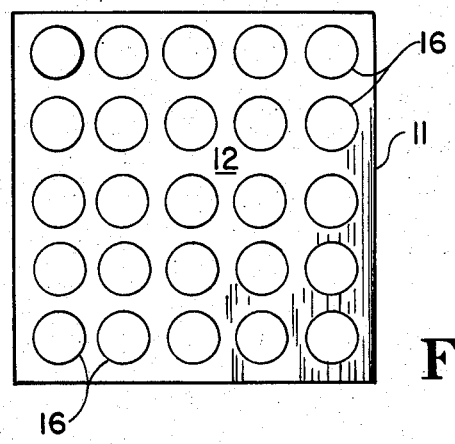
FIG. 2 is an end view of the primary protective casing of the embodiment shown in FIG. 1.
Figure 4:
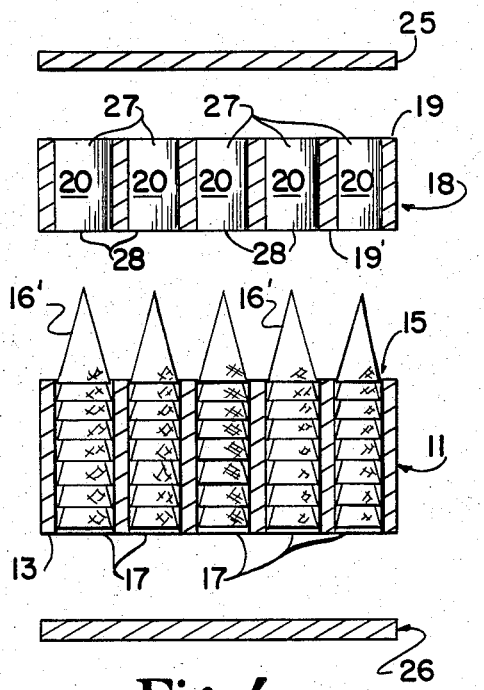
FIG. 4 is an exploded section view similar to that of FIG. 3, showing the cones as contained therein.

In use of the first disclosed embodiment of the bulk pack container 10, twenty-five eight-cone stacks of nested, standard-sized ice cream cones are placed within the passageways 15 of the primary body 11. As shown in FIG. 4, a portion of the stack will extend beyond the top surface 12 of the primary body 11. The secondary body 18 is then mounted on top of the primary body 11 to form the arrangement shown in FIG. 2. The cover members 20 and 21 are then placed in position to cover the top surface 19 of the secondary body 18 and to the bottom surface 13 of the primary body 11. The entire foam assemblage consisting of the cover members 25 and 26, primary body portion 11 and secondary body portion 18 are then inserted into the container 30 on the container may be formed about the assemblage.

Alternatively, the bottom cover member 26 may first be placed within the container 30 so as to rest upon its bottom surface. The primary cone-receiving body 11 may then be placed into the container 30, and the twenty-five stacks of nested cones placed into the passageways 15. The secondary cone-receiving body 18 and top cover member 25 are then placed within the container 30 in such a manner as to place the stacks of nested cones 16' into the passageways 20 and envelope them in the resilient foam material.

After the protective bulk pack container 10 has been shipped to a desired location, the container may be stored temporarily prior to use of the cones. It will be appreciated that the resilient cover members 25 and 26, primary cone-receiving body 11, and secondary cone-receiving body 18 are of such rigidity that they will not deform when exposed to humidity or other potentially harmful conditions. Furthermore, should the bulk pack container 10 be dropped or mishandled in some manner, the foam members 11, 18, 25 and 26 will absorb the force of impact against the paperboard container 30, thereby preventing the breakage of any cones 16'.

Furthermore, once it is desired to use the cones, the protective bulk pack container 10 is opened by undoing the flaps 35, 36, 37 and 38 of the paperboard container 30. The top cover member 25 is removed and disposed of. The very tip end of each of the twenty-five stacks of ice cream cones 16 are now accessible. However, to ease this accessibility, the secondary body portion 18 may also be removed and disposed of. Thus, the interior of the paperboard container 30 now appears as shown in FIG. 4, wherein several cones from each stack are exposed. In this way, one desiring to remove a cone 16 from the container is provided with direct access thereto. The cones 16 may be withdrawn from the primary body portion 11 at any time desired. Additionally, if it is desired to encase these uppermost cones 16', the secondary body portion 18 may be retrieved and mounted once again upon the primary body portion 11.

A second embodiment of the present invention provides a single cone-receiving body in place of the primary body 11 and secondary body 18. This single cone-receiving body is also formed of a lightweight, rigid and resilient material and defines a plurality of passageways that receive the stacks of nested cones. It will be appreciated that such a single cone-receiving body is substantially identical in construction to either the primary body 11 or the secondary body 18, yet of sufficient height to receive an entire stack of nested cones.

Thus it is seen that a protective bulk pack container according to the present invention provides many advantages over the prior art. Because the cover members 25 and 26, primary cone-receiving body 11 and secondary cone-receiving body 18 are made of a rigid yet resilient material, the preferred container 10 neither relies on the paperboard container 30 nor on the cones 16' themselves to define and maintain the structure of the container. Furthermore, the cones 16' are received in passageways that yield to their structure, thereby eliminating any damaging frictional contact between the cone and the sidewall. Further, the present invention conserves space by utilizing a nested cone 16' stack arrangement, but also isolates each such stack within the cone-receiving bodies 11 and 18 so as to prevent any. Finally, and perhaps most importantly, the present invention substantially reduces breakage loss because the stacks of nested cones are completely enveloped by the foam material. For example, it is known that the use of many prior art ice cream cone containers has resulted in as much as a ten percent (10%) breakage loss of the contained volume through normal shipping and handling. The preferred embodiment of the present invention has reduced such loss to one-half of one percent (0.5%) of the contained volume.

It should be understood, of course, that the foregoing relates only to the preferred embodiments of the present invention and that numerous modifications or alterations may be made therein without departing from the spirit or the scope of the invention as set forth in the appended claims.

I claim:

1. A protective bulk pack container for ice cream cones, comprising:

a plurality of stacks of nested ice cream cones, each of said cones being of substantially identical outside diameter;

a first protective body formed of a semi-rigid and resilient plastic foam material, said first protective body defining a plurality of cylindrical cone-receiving passageways extending the height thereof, so as to define openings in the top surface and the bottom surface thereof, each of said passageways in said first protective body being of such a diameter as to yieldingly receive one of said plurality of stacks of nested ice cream cones without causing damage to any of said cones but to suspend each of said cones within said stack within said passageway, thereby preventing any lateral movement thereof;

a second protective body formed of a semi-rigid and resilient plastic foam material, said second protective body defining a plurality of cylindrical cone-receiving passageways extending the height thereof, so as to define openings in the top surface and bottom surface thereof, each of said passageways in said second protective body being of a diameter substantially equal to that of said passageways in said first protective body, said second protective body being configured for placement on top of said first protective body so as to align said passageways of said second protective body with said passageways of said first protective body;

a top cover member disposed on the top surface of said second protective body, said top cover member being formed of a rigid and resilient plastic foam, and dimensioned to cover each of said plurality of openings defined in said top surface of said second protective body;

a bottom cover member disposed on the bottom surface of said first protective body, said bottom cover member being formed of a rigid and resilient plastic foam, and dimensioned to cover each of said plurality of openings defined in said bottom surface of said first protective body; and an external container dimensioned to snugly receive said first protective body, said second protective body, said top cover member and said bottom cover member, whereby insertion of a plurality of nested stacks of ice cream cones into said plurality of cone-receiving passageways in said first protective body and said second protective body provides a casing which envelopes said stacks of cones for shipping and storing and removal of said top cover member and said second protective body provides a container from which the cones may be dispensed.

2. The protective bulk pack container of claim 1 wherein said first protective body is formed having a greater height than that of the second protective body.

* * * * *